US005235497A

United States Patent [19]

Costa

[11] Patent Number: 5,235,497

[45] Date of Patent: Aug. 10, 1993

[54] LUMINESCENT FIXTURE PROVIDING DIRECTED LIGHTING FOR TELEVISION, VIDEO, AND FILM PRODUCTION

[76] Inventor: Paul D. Costa, 1417 Bernal Ave., Burlingame, Calif. 94010

[21] Appl. No.: 691,702

[22] Filed: Apr. 26, 1991

Related U.S. Application Data

[63] Continuation-in-part of Ser. No. 410,258, Sep. 21, 1989, Pat. No. 5,012,396, which is a continuation of Ser. No. 177,099, Apr. 4, 1988, abandoned.

[51] Int. Cl.[5] ..... F21S 3/00

[52] U.S. Cl. ..... 362/224; 362/11; 362/16; 362/260; 362/321; 362/342

[58] Field of Search ..... 362/217, 3, 16, 260, 362/224, 20, 11, 221, 317, 319, 321-324, 326, 341, 343, 362, 342, 216

[56] References Cited

U.S. PATENT DOCUMENTS

| | | | |
|---|---|---|---|
| 2,732,483 | 1/1956 | Elmer | 362/260 |
| 2,735,522 | 2/1956 | Lee | 362/317 |
| 3,220,065 | 11/1965 | Graham | 362/321 |
| 3,253,082 | 5/1966 | Buset | 362/317 |
| 3,566,102 | 2/1971 | Choyke, Jr. | 362/317 |
| 4,562,517 | 12/1985 | Pankin | 362/217 |
| 4,682,078 | 7/1987 | Pascalide | 362/20 |
| 4,794,501 | 12/1988 | Bartenbach | 362/217 |

*Primary Examiner*—James C. Yeung

*Attorney, Agent, or Firm*—David E. Newhouse

[57] ABSTRACT

A luminescent fixture for providing sustained illumination suitable for television, video and film production includes a plurality of parallel mercury vapor luminescent lamp tubes aligned in close proximity in a common plane bisecting an acute concave angle defined by high reflectivity facing surfaces of a pair of longitudinal reflector panels. A plurality of separate electronic ballasts located at the base of the extending reflector panels provide a plurality of unsynchronized electrical current pulse trains each for exciting pulsed ultraviolet light emissions from Hg vapor within a particular set of lamp tubes at a rate sufficient to excite/stimulate sustained luminescent light emission from the phosphors in the emulsion coating lining the interior of the light tubes, i.e., at a rate sufficient to excite/stimulate pulsed fluorescent and phosphorescent light emission of a desired color/chromacity, each pulse having a duration greater than that of the exciting electrical current pulses, such that each luminescent light pulse emitted overlaps emission of the subsequent luminescent light pulse excited/-stimulated in each tube. The lack of synchronization in output of the electronic ballasts precludes coherency in the respective electrical current pulse trains and therefore any coherency in the respective luminescent light pulse trains emitted by the respective lamp tubes to minimize intensity ripple in light emanating from the fixture.

50 Claims, 11 Drawing Sheets

39
40
41
42
43
44
46
47
48
49
51
52
53
54
57
58
59
35°
AC

LUMINESCENT FIXTURE PROVIDING DIRECTED LIGHTING FOR TELEVISION, VIDEO, AND FILM PRODUCTION

RELATED APPLICATIONS

This application is a continuation-in-part of a continuation application Ser. No. 07/410,258, filed U.S. Pat. No. 5,012,396, in the United States of America on Sept. 21, 1989 by the applicant, Paul D. Costa entitled: "METHOD AND APPARATUS FOR ILLUMINATING TELEVISION STUDIO AND VIDEO TAPE PRODUCTION FACILITIES." Parent application, Ser. No. 07/177,099, now abandoned, was filed by applicant, Paul D. Costa in the United States of America on Apr. 4, 1988.

BACKGROUND OF THE INVENTION

1. Field of the Invention

The invention relates to luminescent lighting systems and luminaires for capturing and directing light emanating from large planer light sources.

2. Description of the Prior Art

Fluorescent tubes produce light largely by conversion of ultraviolet radiations excited by electrical arc discharges through a low pressure gaseous medium within the tube containing mercury vapor into visible light through a process called photoluminescence, i.e. a nonthermal emission of electromagnetic radiation by materials called "phophors" upon excitation or absorption energy from higher energy (ultraviolet) radiations. The absorption and re-radiation of the light at the longer wavelengths by the phosphors is variously described as fluorescence and phosphorescence. The phosphors are typically high purity crystalline compounds which are deposited onto the interior walls of the tube. [See *IES Lighting Handbook* 5th Ed. 1972, pp 2-8, 2-9.]

By convention fluorescence has been and is defined as the process of emission of electromagnetic radiation by a substance as a consequence of the adsorption of energy from radiation, provided that the emission continues only so long as the stimulus producing it is maintained, i.e., a luminescence which ceases within about 10 nanoseconds after excitation stops. Phosphorescence has been and is defined as luminescence that is delayed more than 10 nanoseconds after excitation stops. [See *Van Nostrand's Scientific Encyclopedia* 7th Ed. pp. 1194, 1737 & 2189–90.]

It is also well known that the gaseous arc discharges in fluorescent lamp tubes are maintained by pulses of electrical current propagating back and forth between electrodes at the respective ends of the tubes supplied by ballast power sources. Typically, the current pulse frequency is twice the complete cycle frequency of the ballast power source, i.e., a current pulse propagating in one direction through the tube in the first half cycle and the opposite direction the second half cycle. [*IES Lighting Handbook* 5th Ed. 1972, pp 2-7/2-9 8-27/8-30; *IES Lighting Handbook*, Reference Vol. (1984) pp. 8-19/8-39 at 8-30; U.S. Pat. No. 4,467,247, Hammer; and U.S. Pat. No. 4,525,649, Knoll.]

Before 1988 light from "fluorescent" light fixtures generally was never thought to be suitable illumination for film, television or video productions, primarily because of the periodicity in the generated light output. For example, ordinary 60 Hz fluorescent lighting fixtures typically produced green 'beating effects' in resulting television and motion picture imagery due to the color of delayed phosphorescence emissions from the phosphors. And, while the pulsing light flashes of the typical 60 Hz fluorescent lighting fixture (at the rate of 120 flashes per second) are not noticeable to the human eye, they have stroboscopic effects when multiple frames images are utilized to record and show motion.

In particular, per conventions adopted as standards in the television and video industries, electronic scanning cameras successively analyze or synthesize (sample) the light values of picture elements or pixels constituting the picture area according to a pre-determined method. The concept of picture elements or pixels as that term is used in the television arts, originated in 1884 with the Nipkow Mechanical-Optical Scanning System. [See Chapter 3 of the *Television and Audio Handbook*, by K. Blair Benson & Jerry Whittaker (1990), pp. 3.2–3.8. See also *Television Engineering Handbook* compiled by K. Blair Benson, published in 1986 by McGraw-Hill, Inc. at pages 4.1–4.9 for a more sophisticated (mathematical) treatment of the concept and theory of picture elements or pixels.] And, while it has not been appreciated until recently, it is generally known that a correspondence between space and time exists in film, television and video media which permit a "pixel's size" to be defined as either a "certain fraction of a scan line", or as "a duration in time". [*Television Engineering Handbook* (supra), Chapter 19, entitled "Digital Video Effects" at pages 19.8–19.9]

For example, the interlacing standards adopted by the television industry in the United States of America, comprises 30 frames/sec where each frame consists of 525 pixel lines. Each frame is further broken down into two parts or fields of even and odd number lines of 262.5 lines to provide a repetition rate of 60 fields/-second (60 Hz). This repetition rate matches the U.S.A. standard AC power line frequency and thus mitigates the effect of 'hum' due to imperfect power supply filtering. 'Hum' causes vertically moving patterns to pass through the image. (For color the repetition rate is slightly reduce to 59.94 Hz which means that a 'hum' interference pattern typically propagates vertically through the reproduced image at a rate of 0.06 Hz.)

Accordingly, if it is assumed that each line consists of 512 pixels or picture elements, then under the U.S. convention, electronic scanning cameras scan (and television sets project) at rate of approximately 15,750 lines/-second or 8,064,500 pixels/second. Inverting these numbers, the duration of the camera's sampling per line and per pixel is approximately 63.5 microseconds/line and approximatly 124 nanoseconds/pixel, respectively [See *Television Electronics: Theory and Servicing* 8th Ed. (1983), pp. 71–72 for a rudimentary discussion of the timing relationships of lines, and pixels.]

Periodicity in illuminating lighting when images are reproduced by television/video has an effect analogous to 'hum' interference patterns attributable to an unsynchronized power supply, only in this case, the patterns move horizontally rather than vertically through the recreated image. For example, if a ballast operating at 31.5 kHz is used to drive a luminescent system to produce 4 distinct flashes per scan line (63,000 flashes/sec) there would be 4 'brighter' vertically oriented bands in the projected image corresponding to the rise and fall times of the particular flashes. The periodicity of the flashes relative to the trace and retrace rates of the rectangular raster, may cause the bands to incline diagonally across the screen.

The Applicant discovered prior to 1988, that it was possible to "tailor" both the color/chromacity and duration of luminescent light emission to produce a sustained luminescent light emission suitable for television and video tape productions. [See parent application, Serial No. 07/177,099, filed by the applicant, Paul D. Costa in the United States of America on Apr. 4, 1988.]

Another perceived disadvantage of luminescent (fluorescent) illumination systems in the television, video film production industries has been the bulk or size of the fixtures. Typically, the fixtures mount long tubes in a spaced parallel flat arrays, a convex cylindrical arrays, or a concave cylindrical arrays. Light emanating from such tube arrays is typically directed perpendicularly outwardly from the array. This means that the effective (light emitting) apertures of such fixtures are quite large, in most cases, subtending solid angles greater than that occupied by the array of tubes. The large effective apertures of such fixtures have generally frustrated efforts to direct and shape the emanating light into beams and spots in the manner that light emanating from conventional incandescent (point) light sources can be directed and shaped.

Accordingly, luminescent (fluorescent) illumination systems have conventionally only been thought of as secondary illumination sources for television, video and film production, useful, for example, to illuminate large backgrounds areas, (U.S. Pat. No. 3,733,480, Glenn, Jr.), and to 'balance' existing fluorescent light illumination at a particular locations, (U.S. Pat. No. 4,728,428, Lowell).

Other disadvantages of existing luminescent (fluorescent) illumination fixtures relate to fact that each tube effectively 'shadows' the light output from its back surface reflected back toward the tube or through the tube plane by a typical reflector. Accordingly, there is a resulting loss of light intensity or (flux density). And in fact, in prior art luminescent (fluorescent) lighting fixtures and luminaires, the brightest or most intense (maximum light flux) light is typically measured as emanating from the facing front surface of the light tube. [See U.S. Pat. Nos. 4,602,448, Grove, 3,733,480, Glenn, Jr., and 2,264,141, Nemeroff.]

SUMMARY OF THE INVENTION

A luminescent illumination fixture is described for providing sustained and directed, primary illumination required for television, video and film production and other applications which includes a frame structure supporting a plurality of mercury vapor luminescent lamp tubes aligned in close parallel proximity in a common plane within a reflector housing having the shape of a trapezoidal hexahedron bisecting a concave angle defined by a pair of highly reflective panels also supported by the frame structure. A pair of trapezoidal like end plates, in combination with the inclined, extending reflective panels, define a rectangular aperture at the base of the trapezoidal hexahedral housing through which the luminescent light generated by the tubes is projected.

A particular advantage of the described fixture is that pivoting "barn-door" reflective panels, honeycomb collimators, "egg-crate" collimating reflectors and/or a combination thereof can be adapted for connection to the edges of, and within the rectangular aperture of the fixture for further collecting, shaping and directing the emanating light.

A plurality of separate electronic ballasts are mounted and shielded within a narrow longitudinal hexahedral volume at the apex of the trapezoidal hexahedral housing, and provide a plurality of unsynchronized electrical current pulse trains each for exciting pulsed ultraviolet light emissions from mercury (Hg) vapor within one or more of the lamp tubes at a rate sufficient to excite/stimulate sustained luminescent light emission from the phosphors in the emulsion coating lining the interior of the light tubes, i.e., at a rate sufficient to excite/stimulate pulsed fluorescence and phosphorescence light emission of a desired color/chromacity, each pulse having a duration greater than that of the exciting electrical current pulses, such that each luminescent light pulse emitted overlaps emission of the subsequent luminescent light pulse excite/stimulated in each tube.

A particular aspect of the invented illumination fixture relates to the fact that the electrical current pulse trains produced by the respective electronic ballasts are not synchronized, a fact which precludes any coherency in the respective trains of luminescent light pulses excited from the respective lamp tubes thereby minimizing intensity ripple in light emanating from the effective aperture of the fixture.

Another aspect of the invented illumination fixture is that a portion of the light emanating from the surface of a each lamp tube is reflected and refracted back into the phosphor containing emulsion coating the interior of the lamp tubes by a synergism of the inclined high reflectivety surfaces of the reflector panels and the light scattering and refracting properties of the convex glass and emulsion surfaces presented to such reflected light by the closely space light tubes in the tube plane whereby stimulating radiative transitions are obtained from the phosphors for amplifying the resultant light output, and whereby the overlap of excited/stimulated luminescent light pulses is temporally broadened.

Still another aspect of the invented illumination fixture is that a portion of the light emanating from the region between the lamp tubes in the light tube plane is reflected and dispersed outwardly from the light tube plane by the respective proximate convex surfaces of the adjacent tubes creating regions between the tubes of higher light intensity (flux density). More, particularly, the luminescing phosphors deposited onto the interior surfaces of the tubes, in the regions between tubes, comprise an inherently dispersive 'convex' light emitting sources. A portion of the light photons emitted from that region are directed outwardly from between the tubes by the lensing effects of light reflecting from the exterior convex glass and phosphor surfaces, respectively of the adjacent tubes. That light then reflects from the highly reflective surfaces of the inclined panels out the effective aperture located at base of the trapezoidal hexahedral reflector housing/frame. Similarly, light directed into the region between the tubes by the angled panels is dispersed outwardly therefrom by the reflective lensing effect of the respective adjacent convex surfaces. The result is a measurable (100 fold) increase of light intensity (flux density) emanating from the regions between the closely space light tubes.

Still other aspects of the invented illumination fixture relate to the reflective lensing (scattering) effect of the exterior convex glass and phosphor surfaces lying in the planes on either side of the tube plane which disperses (divergently reflects) a substantial portion of the light directed onto those surfaces by the angled reflective panels either out the effective aperture of the fixture or back to the angled reflective panels. An additional advantage of such multiple reflections is an effective lengthening of the duration of each luminescent light pulse emission excited/stimulated from the planar array of closely spaced luminescent light tubes.

Also, an aspect of the invented luminescent light fixture is the synergism of the acutely angled reflective panels, the described dispersive reflective lensing and light scattering effects of the convex glass surfaces, and the convex surfaces of the phosphor containing emulsion lining the interior surfaces of the luminescent tubes bisecting the acute angle between the reflective panels, and the inherently divergent light emission from phosphors deposited onto the convex interior surfaces of the light tubes, which combine to provide an energy efficient, highly directional and uniform light source of more than sufficient flux/intensity and chromaticity for film, television and video production.

An observed advantageous phenomenon of the invented illumination fixture is that the (light emitting) surface of the outermost luminescent tube is somewhat dimmer measurably (and to observing eye) than the visible convex surfaces of tubes lying inwardly in the tube plane bisecting the acute angle defined by the reflective panels. In fact talent (actors and screen personalities) can look directly into the fixture without squinting or otherwise shielding their eyes from the emanating light, and are easily able to read telepromters or cue cards located behind the light emitting aperture of the fixture.

Still other advantages of the invented illumination fixture relate to the ability to shape and direct light from the fixture for 'modeling' talent and objects. And, by utilizing light dispersive films (paint) on the reflective surfaces of the acutely angled reflective panels, highly uniform light fields without significant variations of flux/intensity (bright spots) and chromaticity differences (mix of light frequencies/wavelengths) are obtainable. The latter light fields are extremely well suited for special 'matte' production effects in film, video and television.

DESCRIPTION OF PREFERRED AND EXEMPLARY EMBODIMENTS

Figure 1:
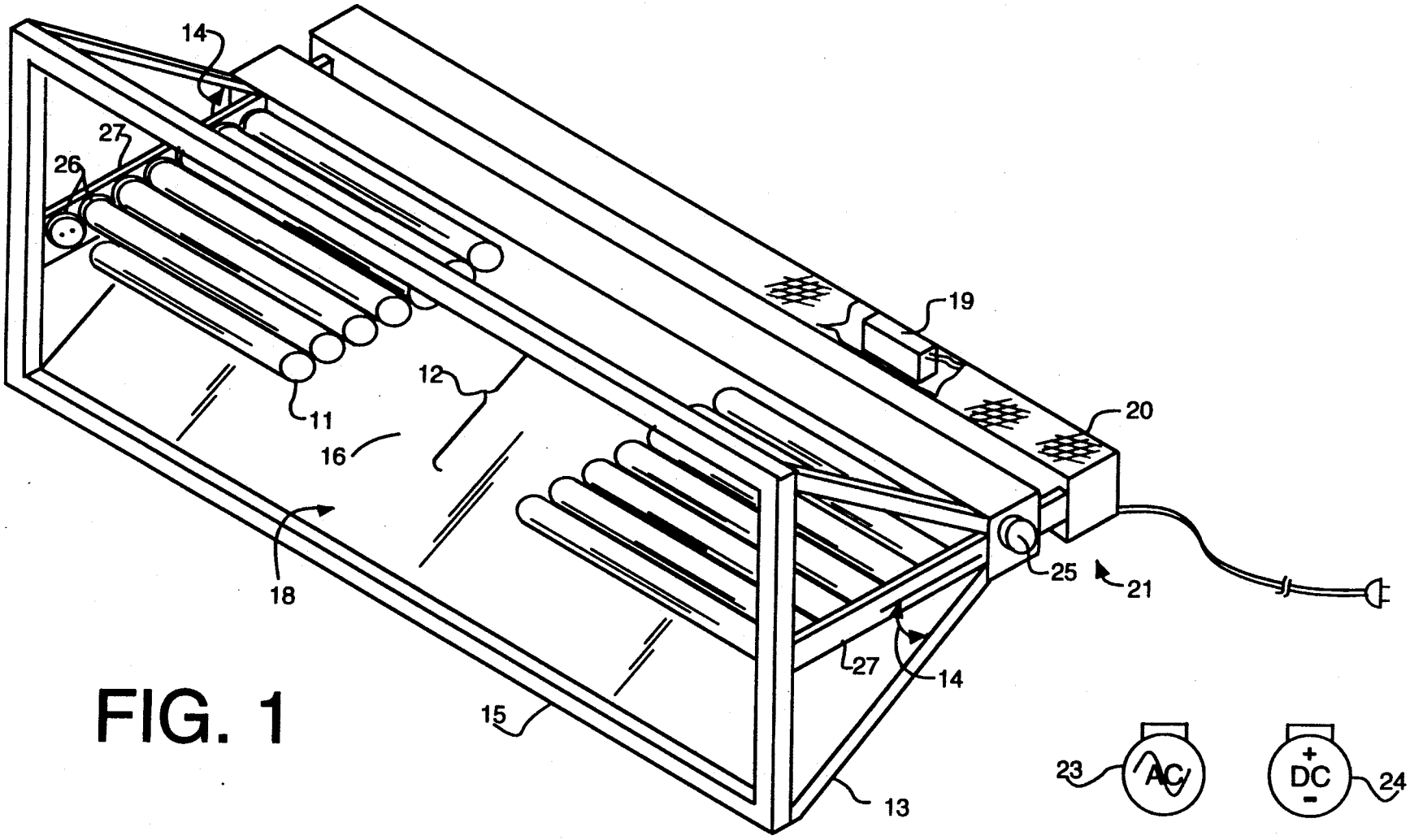
FIGS. 1 & 1*a* are perspective renderings showing the basic components of the invented illumination fixture.
Figure 1A:
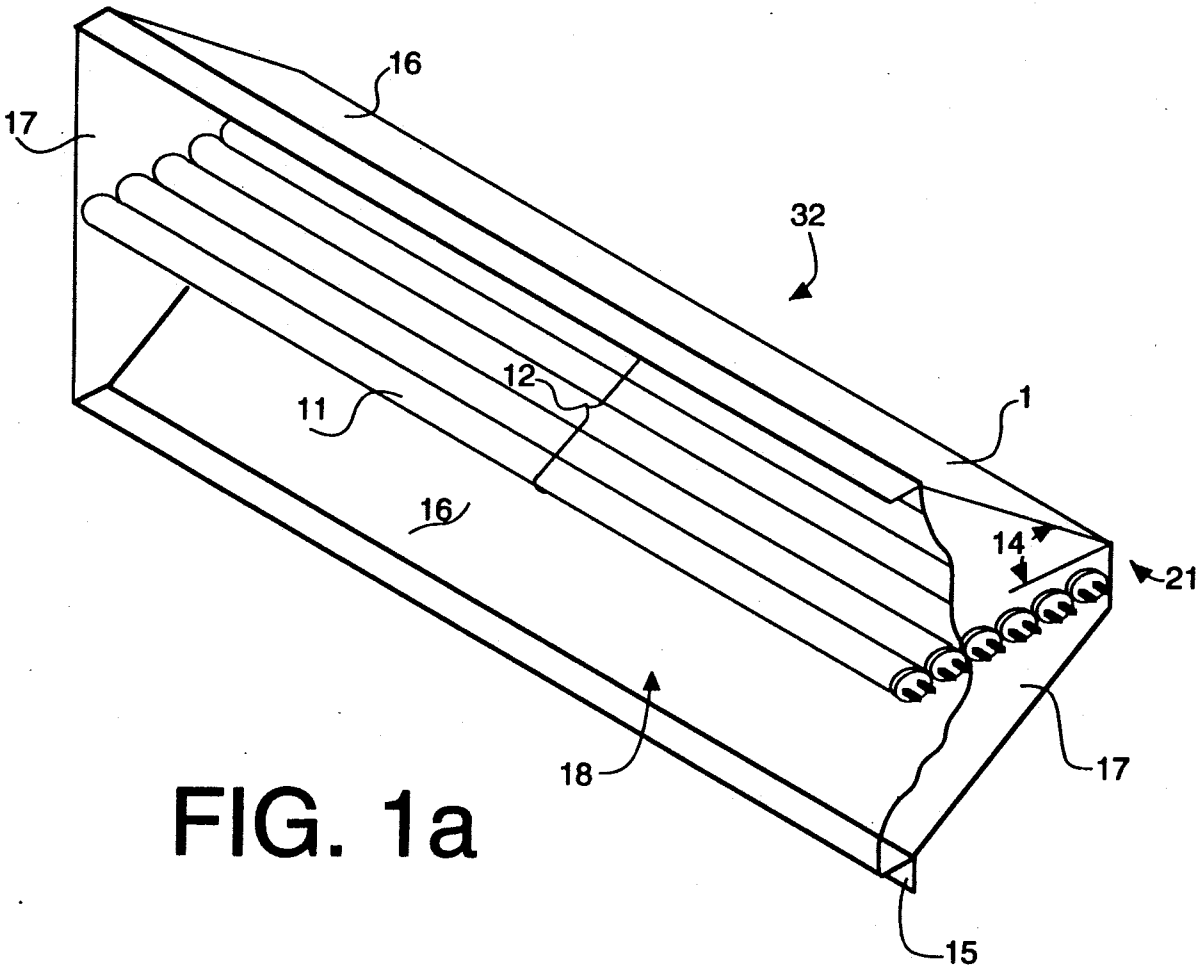
Figure 3:
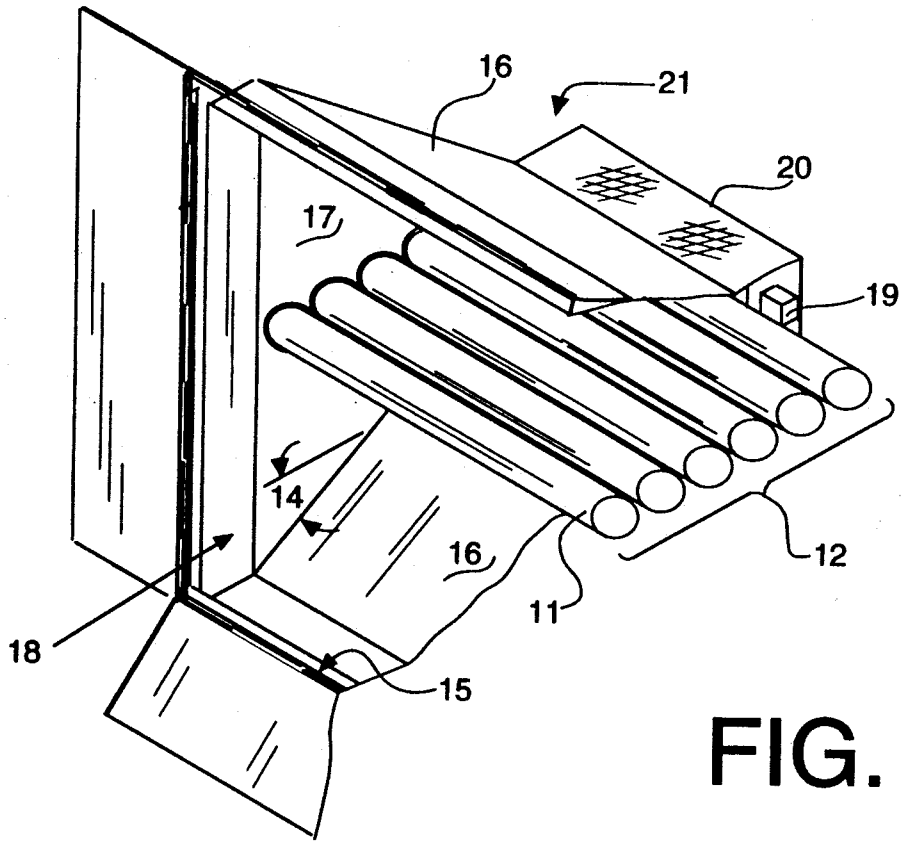
FIG. 3 is a cut away perspective rendering of the invented illumination fixture illustrating the proximity of the luminescent light tubes.

Referring to FIGS. 1, 1*a* and 3 the basic components of the invented illumination fixtures include a planer array of mercury vapor luminescent lamp tubes 11 aligned in close proximity in a common plane 12 within a trapezoidal hexahedral frame 13 bisecting a concave angle defined by a pair of highly reflective, inclined panels 16 (FIGS. 1*a* and 3) also supported within the frame 13. The reflective panels 16 converge toward the tube plane 12 at an acute angle 14 ranging from 30° up to 45° such that the total angle subtended between the reflective panels 16 ranges from 60° up to 90°. A pair of trapezoidal reflective end plates 17, in combination with the inclined reflective panels 16, define a rectangular (light emitting) aperture 18 at the base 15 of the trapezoidal hexahedral frame 13 through which the luminescent light emanating from the tube plane 12 within the reflector housing 32 defined by the frame structure 13 is projected by the reflector panels 13. A plurality of separate, high frequency, solid state electronic ballasts 19 are mounted and shielded within an rf shielded, hexahedral volume located at the apex 21 of the trapezoidal hexahedral frame 13.

As shown in FIG. 1, the ballasts 19 are mounted in a separate hexahedral rf shielded volume 20 mechanically located across a conventional pivotable mounting mechanism 25 from the bulk of the fixture. In the embodiment shown in FIG. 1, a pivotable mounting mechanism 25 is located at the apex 21 at each of the frame structure 13 for providing a tilting axis, longitudinally aligned with the frame apex 21. The location of ballasts 19 in the rf shielded volume 20 mechanically extending from the tilt axis counterbalances the the bulk of the fixture, and provides necessary thermal isolation of the luminescent tubes 11 and the electronic ballasts 19.

Figure 2A:
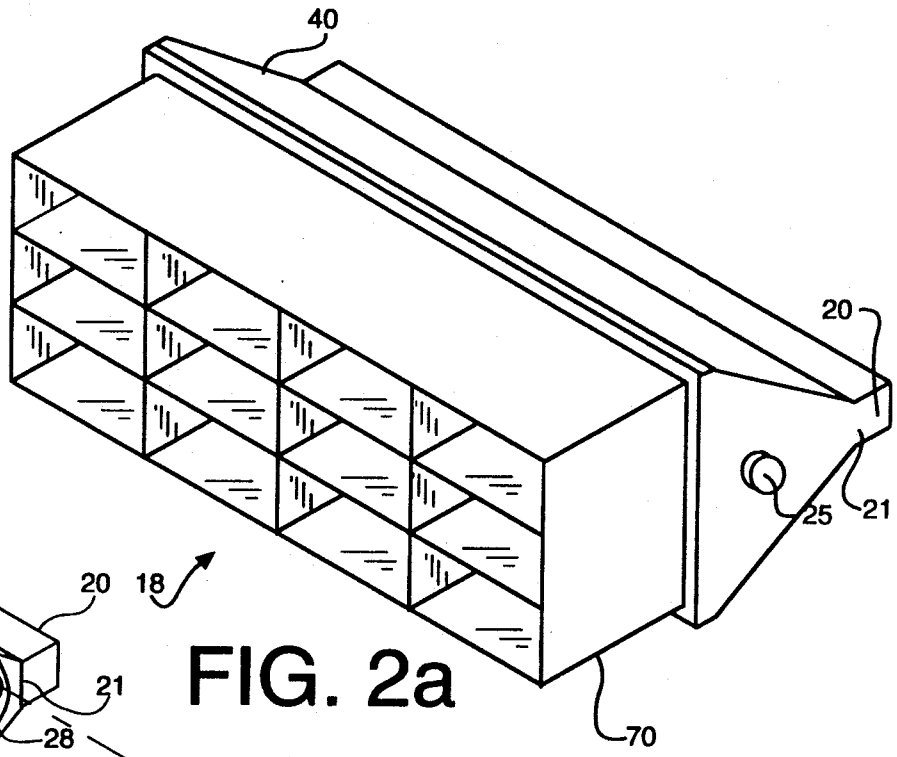
FIG. 2*a* is a perspective rendering of a conventional 'egg-crate' light collimator adapted for mounting onto the light output aperture of the fixture shown in FIG. 2.
Figure 2:
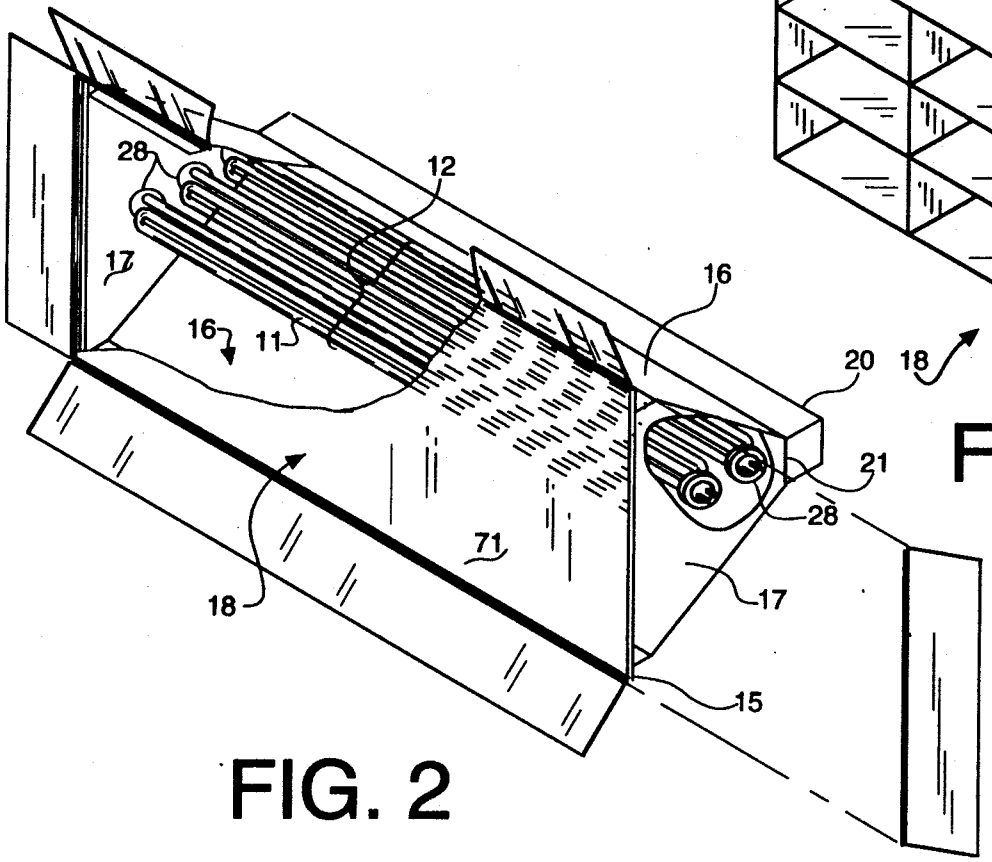
FIG. 2 is a perspective rendering of the invented illumination fixture with barn door reflector panels and 'U-shape' luminescent light tubes.

As shown in FIGS. 2 and 3 the ballasts 19 are mounted in a hexahedral rf-shielded volume 20 located at the apex of the frame 13. In this embodiment a separate exterior housing 40 (FIGS. 2*a* and 7) is secured to and surrounding the trapezoidal hexahedral frame 13 and hexahedral rf-shielded volume 20. For this embodiment, a separate electrical fan (not shown) circulates air into and throughout the interior of the housing for cooling the lamp tubes 11 and the electronic components (ballasts 19). Also conventional pivotable mounting mechanisms (axles) 25 are secured to opposite sides of the frame 13 and extending through the exterior housing 40 to provide a tilting axis aligned with the tube plane 12. The pivotally mounting mechanisms 25 are preferably aligned with the an axis of symmetry of the fixture in the lamp tube plane 15 parallel its aperture 18 such that weight or mass of the components of the fixture are counterbalanced when the fixture is pivotally supported/suspended by a stand or ceiling mount secured to the mounting mechanisms (axles) 25 extending from the ends of the fixture.

Each ballast 19 is electrically connected by conventional means to one or more of the lamp tubes 11 to provide electrical current pulse trains for exciting pulsed ultraviolet light emissions from the mercury (Hg) vapor within one to two tubes 11 at a rate at least greater than the line scanning/frame rate of a television/video/film camera (not shown), i.e. at a rate ranging from 20,000 to 200,000 electron current pulses per second. The content of the phosphor of the emulsion coating 38 lining the interior surfaces of the luminescent tubes 11 is chosen to emit luminescent (fluorescence and phosphorescence) light pulses of a desired color/chromacity responsive to the pulsed ultraviolet light pulses exited from the mercury vapor by the electron pulses supplied by the ballasts 19. The electron current pulse rate should be sufficiently high such that each luminescent light pulse ultimately excited/stimulated from the emulsion coating 38 has a duration greater than that of its originating electrical current pulse, such that each luminescent light pulse emitted overlaps emission of the subsequently excited/stimulated luminescent light pulse in each tube 11, to thereby provide sustained luminescent light emission from each tube 11 in the planar array 12.

The electrical current pulse trains generated by the respective ballasts 19 are not synchronized in order to preclude any temporal coherency in the respective trains of (overlapping) luminescent light pulse excited from the respective lamp tubes to thereby further minimizing any intensity ripple in light emanating from the effective aperture of the fixture.

The electrical power supply for the electronic solid state ballasts 19 is typically a conventional AC power source 23. Ideally, the solid state ballasts 19 should be also be adapted to be powered from conventional DC power sources 24 such as batteries.

As shown in FIGS. 1 and 1*a* the luminescent lamp tubes 11 are conventional fluorescent lamp tubes with two electrical post connections at each end. The tubes 11 are supported by and electrically connected to the ballasts 19 via conventional two prong sockets 26 secured to tube support arms 27 extending from the apex 21 of trapezoidal hexahedral frame 13 to its base 15 at either end of the structure.

Alternatively, as shown in FIG. 2, the luminescent lamp tubes 11 can be conventional 'U-shaped' lamp tubes, i.e., all biaxial, compact quad fluorescent lamp tubes which have up to four electrical post connections at a base end and two or more communicating tubes with phosphor containing emulsion interior coatings extending from the base. The bases of such 'U-shaped' tubes are received and supported by conventional four post electrical connector sockets 28 mounted on the tube support arms 27, (FIG. 1). As shown in FIG. 2, the 'U-shaped' luminescent lamp tubes 11 connected and supported by one support arm 27 interleave in a common plane with the 'U-shaped' tubes 11 connected to and supported by other support arm 27.

Figures 8A, 8B, 8C:
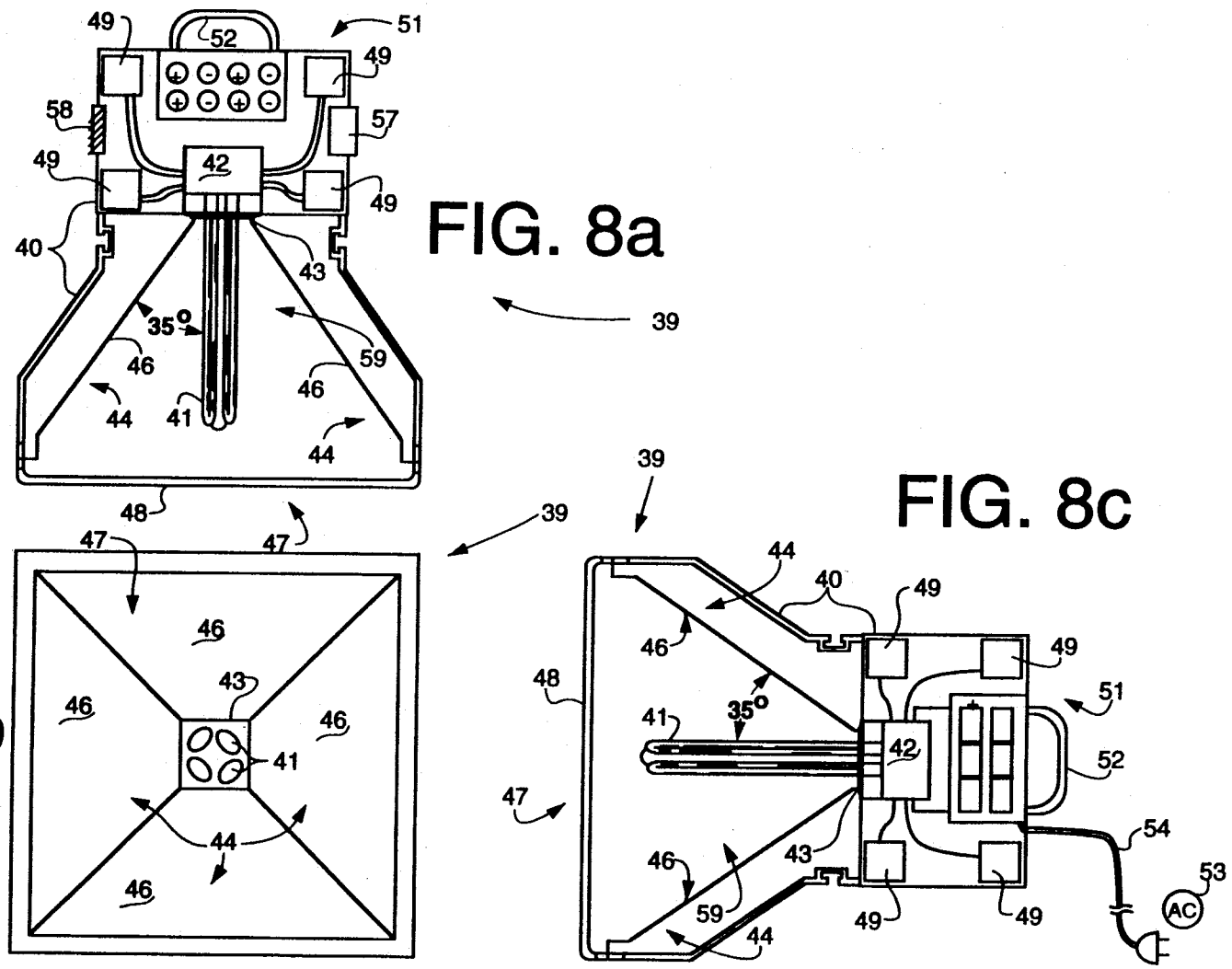
FIGS. 8*a*, 8*b* and 8*c* shows top, front and side elevation views respectively of portable illumination fixture constructed according to the teachings of the present invention with 'U-shaped' luminescent tubes extending perpendicularly toward the light emitting aperture of the fixture.

A portable fixture 39 is illustrated in FIGS. 8*a*, 8*b* and 8*c*. In the fixture 39, four 'U-shaped' luminescent lamp tubes 41 are connected and supported by conventional four post electrical connector sockets 42 mounted at the truncated apex 43 of a reflector housing 44 in the shape of a quadrangular pyramid. The lamp tubes 41 extend perpendicularly, parallel the axis of the reflector housing 44 bisecting the respective angles between the respective opposite facing high reflectivity surfaces of reflector panels 46. The light emitting aperture 47 is located at the base of the reflector housing 44. An appropriate light scattering/directing lense 48 is disposed across the light emitting aperture 47 of the fixture 39.

Figure 7:
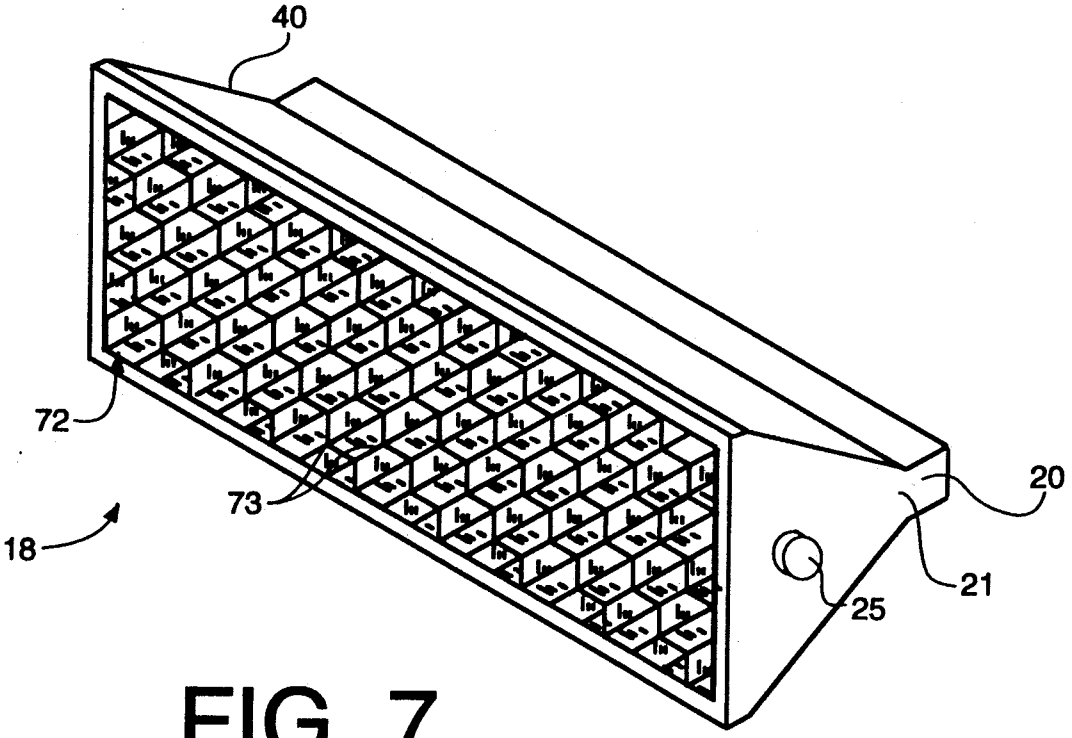
FIG. 7 is a perspective rendering of the invented illumination fixture with a honeycomb light collimator composed of reflective aluminum for directing light emanating from the the fixture.

Ideally, the fixture 39 should include mechanical features to allow interchange/substitution of different lenses 48 and light directing devices such as 'egg-crate' and 'honeycomb' light collimators shown in FIGS. 2 and 7, as well as to allow for removable attachment of 'barn door' reflector panels of the type shown in FIG. 2.

High frequency, solid state ballasts 49 are located and supported within the exterior housing 40 in the volume 51 behind the pyramid reflector housing 44. A removable battery pack 52 supplies electrical power to the ballasts 39 which in turn drive the luminescent light tubes 41 with appropriate high frequency current pulses (ranging from 20,000 to 200,000 current pulses per second). Alternatively, electrical power is supplied to the solid state ballasts 49 from a conventional AC power source 53 through an appropriate rectifying circuit (not shown) via a conventional electrical cord having a plug 54 adapted to plug into a conventional electrical wall socket (not show).

The removable battery pack 52 should contain batteries 56 adapted for recharging. An electrically powered fan 57 can be mounted on one wall of the exterior housing 40 enclosing the volume 51 behind the reflector housing 44 for circulating air into and through the interior of the housing 41 and out a vent 58 through the opposite housing wall. It may also be necessary to circulate air into and out of the volume 59 enclosed within the reflector housing 44 for cooling and improving the quality and intensity of luminescent light emission from the light tubes 41. (See infra)

Referring now to FIGS. 4, 4*a*, 4*b* and 4*c*, an inward facing longitudinal planer highly reflectivity surface 31 is located at the apex 21 of the trapezoidal hexahedral frame 13 behind the innermost light tube 11. Accordingly, the luminescent lamp tube plane 12 is surrounded on five sides within a reflective housing 32 in the shape of a trapezoidal hexahedron where the aperture 18 of the reflector housing 32 comprises the base area of the trapezoidal hexahedron. In embodiments where the light tubes 11 are mounted and extend toward the aperture 18 from the longitudinal frame member 29 at the truncated apex 33 (FIG. 8) of the reflector housing 32, the interior surface of that member 29 should be highly reflective. Accordingly, a substantial portion, if not all, luminescent light emissions emanating from the tube plane 12 are scattered, reflected and directed toward the light emitting aperture 18 defined at the base of the hexahedral reflector housing 32.

Figure 4:
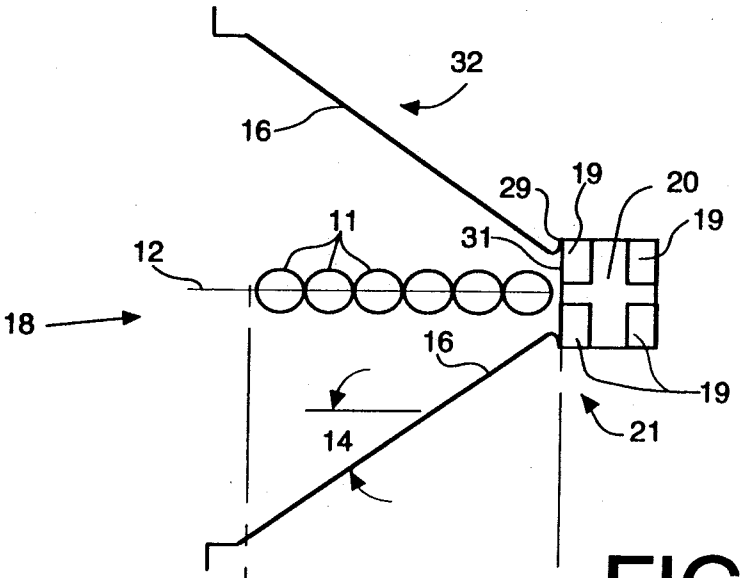
FIG. 4 is a side elevation cross section diagram of the invented illumination fixture.
Figure 4A:
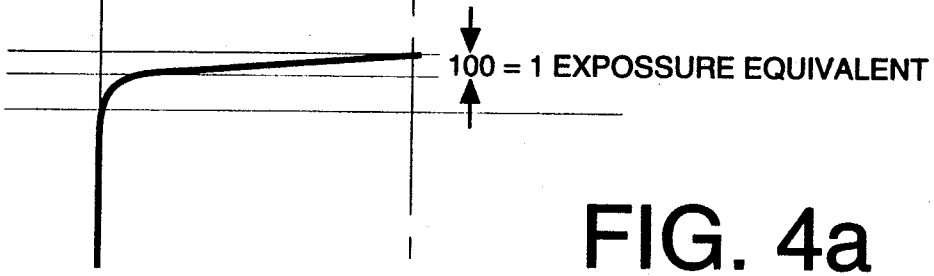
FIG. 4*a* is a graph illustrating a relative increase in light intensity (flux density) measured by a 1° spot meter moved from the facing surface of the front luminescent tube face into the fixture toward angled reflective panel along the respective upward and downward surfaces of the planar array of luminescent tubes behind the front tube in units of exposure equivalents.
Figure 4B:
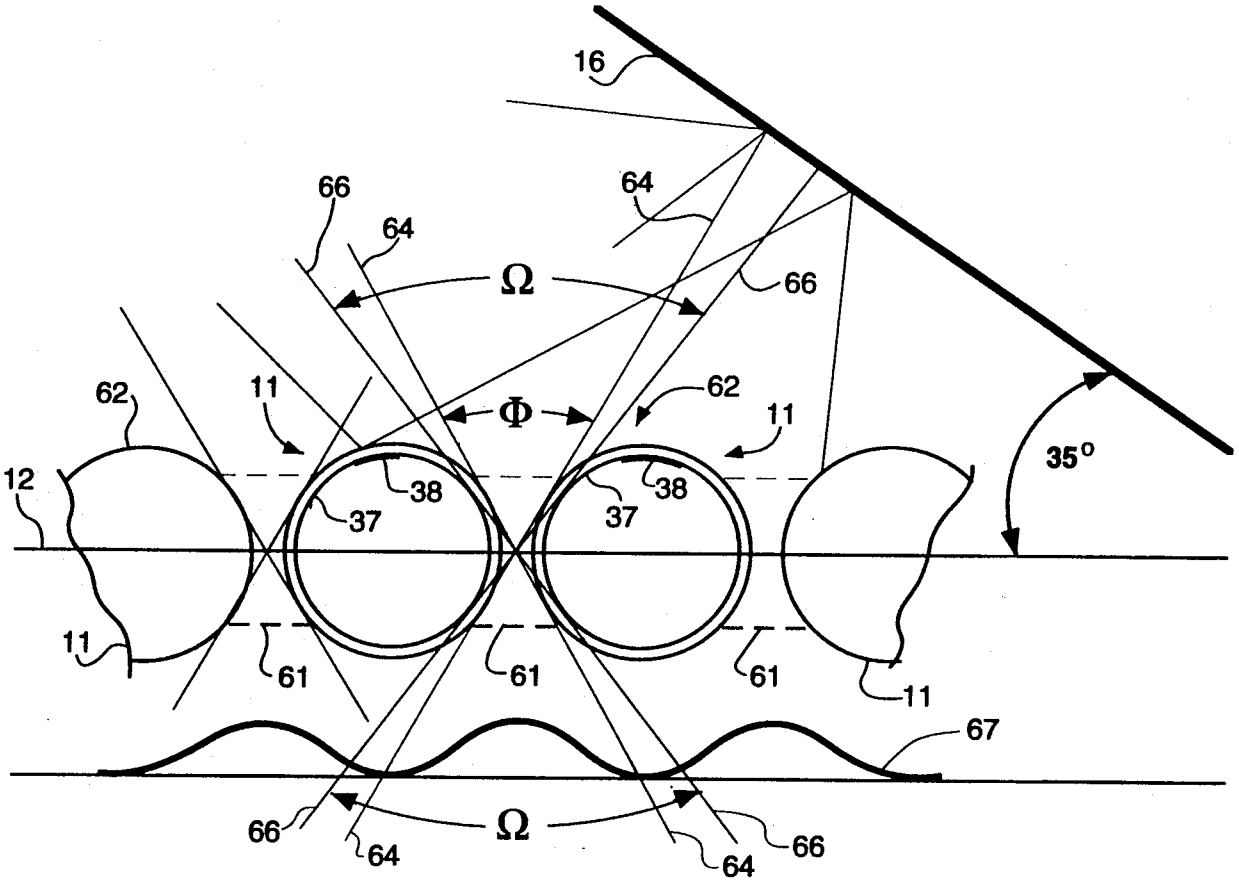
FIG. 4*b* is an enlarged cross section diagram of some of the luminescent tubes of the invented fixture illustrating light reflection paths within the fixture combined with a graphical representation of relative increases of light intensity (flux density) measured as emanating from the regions between the tubes.
Figure 4C:
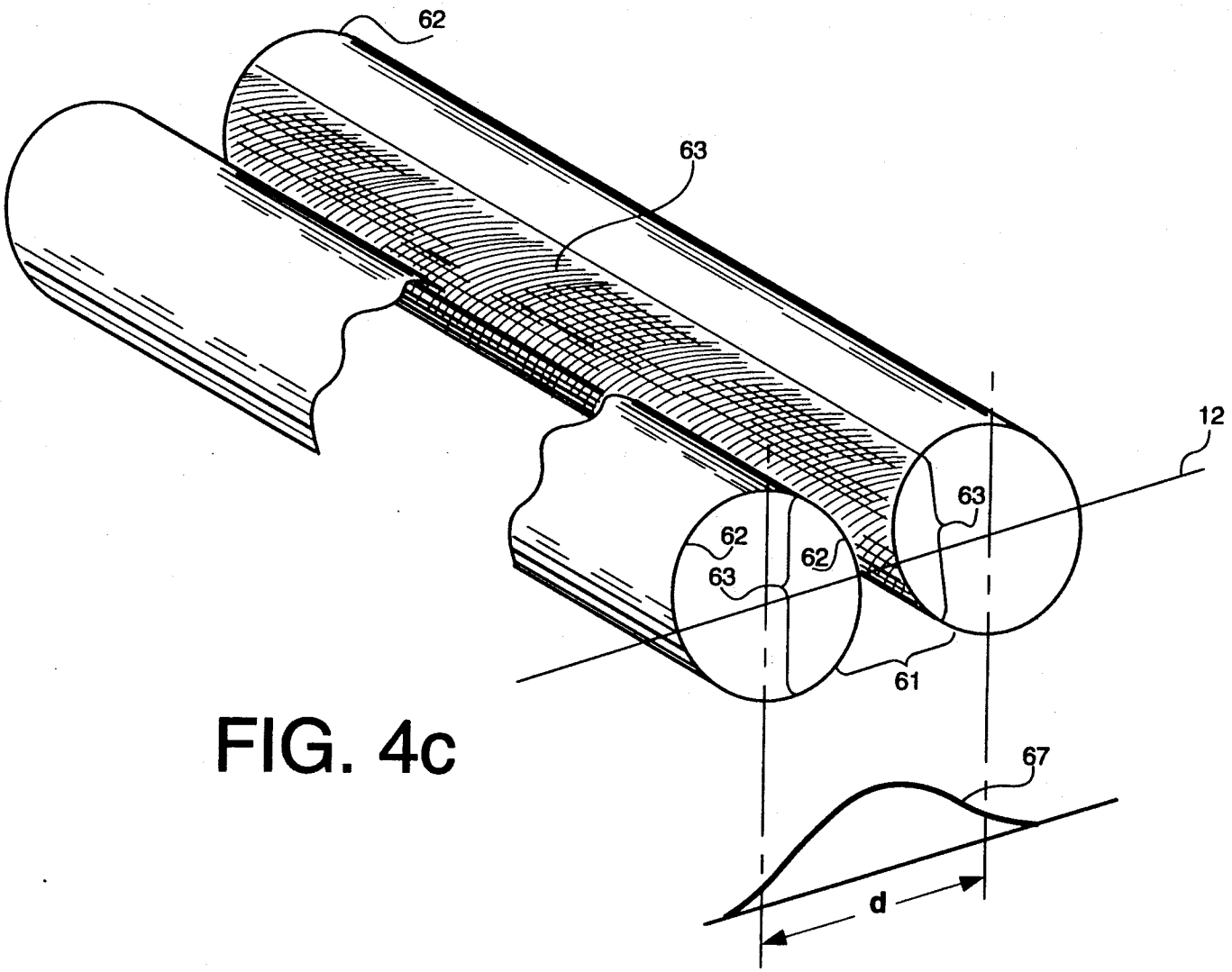
FIG. 4*c* is an enlarged perspective rendering of a pair of luminescent light tubes illustrating observations of higher light intensity (flux density) in the regions between the tubes in the light tube plane.

As illustrated by the graph of FIG. 4*a*, comparison measurements of light intensity (flux density) emanating and scattering from the upward and downward facing convex surfaces of the light tubes 11 within the reflector housing 32 show an increase by a factor of at least 100 as one moves from the outermost tube 11 to the innermost tube 11 at the apex 33 of the reflector housing 32. This observed phenomenon results from the synergism of the flat inclined reflective panels 16 and the reflective and refractive light scattering and lensing effects of the exterior convex glass and phosphor surfaces presented by the tubes 11. In particular, high reflectivity of the inclined reflective panels 16 reflects/scatters light either out the aperture 18 or back toward the convex surfaces of the tubes 11 in the tube plane 12. With reference to FIGS. 4*b*, it should be understood that a portion of the light striking the outer convex tube surface 36 is reflected/scattered back toward the inclined reflective panel 16, a portion is reflected/scattered toward the aperture 18 of the fixture and a portion is refracted and directed toward the interior tube surface lined with the emulsion 38 containing the luminescing phosphors. This refracted light is again scattered, reflected and refracted in the same manner by the convex surface of the emulsion 38 coating the interior surface 37 of the tubes 11. A portion of the light refracted into the emulsion 38 will stimulates radiative emissions from the excited energy states of the phosphors within the emulsion. (See discussion infra.)

In the regions 61 between the tubes 11, (FIG. 4*b*) a synergism between the proximate convex tube surfaces 62 causes an increase in intensity of light emanating from that region. In particular, with reference to FIG. 4*c*, a brighter light emitting area 63 is visually discernable on the light emitting surface of the adjacent tubes. It is observed that interrupting the light emanating from the adjacent tube surface creates an area on the light emitting tube surface of the observed adjacent tube of less intensity, i.e. a shadow is visually apparent. Accordingly, in order to maximize light intensity output at the light emitting aperture 18 of a particular fixture, the distance 'd' (FIG. 4*c*) between the adjacent light tubes 11 should be adjusted such that the discernable area of brighter light emission 63 observed on the convex surfaces of the adjacent tubes is maximized.

In more detail, referring back to FIG. 4*b*, the lines 64 tangentially touching the respective outer glass surfaces 34 of the adjacent tubes 11 define an angular envelope Φ within which light emanating from a tube surface within or scattered into region 61 by the angled reflectors 16 is not scattered or refracted by the glass surfaces of the tubes 11. For purposes of this discussion, luminescent light emissions emitted from an arbitrary small area of phosphors within the emulsion coating 38 on the interior surfaces of the tubes 11 are assumed spherically uniform, i.e., omni-directional. This means that a portion of phosphor emitted light photons propagating from the glass surfaces of the adjacent tubes 11 at angles within the angular envelope Φ delineated by the tangential lines 64 will not be scattered or refracted. The remainder of the light photons propagating in the region 61, i.e. light waves propagating from surfaces of the adjacent tubes 11 or reflected into the region 61 between the tubes 11 by the angled reflectors 16 at angles outside the envelope delineated by the tangential lines 64 are scattered by or refracted into the glass surfaces of the tubes 11.

Similarly, light emissions propagating from tube surfaces or scattered into the region 61 between the tubes 11 by the angled reflectors 16 are scattered by or refracted into the emulsion 38, if the waves propagate at angles outside an angular envelope Ω defined by the lines 66, tangentially touching the exterior surface of the emulsion 38 coating the interior surfaces 37 of the tubes 11. [It should be noted that refraction of light waves at the glass-air interface and the glass-emulsion interface will alter the angle of the intersecting lines 66, a phenomenon that is ignored for purposes of this discussion.]

From the above, it should be realized that intensity of light emanating from the region 61 is greater than that emanating from the surface of a tube 11 outside that region. And, this supposition indeed corresponds to relative measurements of light intensity (flux density) as emanating from the regions as shown by the graphs 67 located below the tube planes 12 (FIGS. 4*b* and 4*c*) which present a rough plot of the observed relative increases in light intensity as a function of position in a plane parallel to and located above and below the tube plane 12.

Compounding the complexity of the observed phenomena of increased light intensity emanating from the regions 61 between the light tubes 11, is the fact that the emulsion 38, containing luminescing phosphors, itself, is quite an efficient and effective light scattering medium. This is why the interior emulsion coatings of your typical luminescent light tube appears to be both white and opaque.

In fact, researcher Ad Lagendijk of the University of Amsterdam and the FOM-Institute for Atomic and Molecular Physics in the Netherlands very recently speculated and reported at the American Physical Society Meeting in March 1991 held in Cincinnati, Ohio, that the velocity of light propagating through a highly disordered scattering medium appears to be one tenth of that previously assumed. [See *Science News* Mar. 23, 1991, Vol. 139, No. 12, p. 182.]

Accordingly, since a greater proportion of light is scattered and refracted into the emulsions 38 coating the interior surfaces in the regions 61 between the tubes 11 than in other regions, analogizing from the reported observations of Ad Lagendijk, it could be that light waves (photons) scattered and refracted into the emulsion are effectively 'trapped' in the region 61 until they are scattered and/or absorbed and re-emitted by the particles of the emulsion at angles where they can not be intercepted by a scattering back into the emulsion the adjacent surfaces, i.e. at angles within the angular envelopes Φ and Ω defined by the lines 64 and 66. It should also be understood the such trapped light photons will also stimulate radiative emission from the discrete emitting metastable energy states of the crystal lattice of luminescing phosphors dispersed in the emulsion.

In particular electrons vibrating in the crystal lattice of the phosphors are optically pumped/excited to higher energy states by the uv light pulses induced by the electron pulse trains through the mercury vapor within the tubes 11. Thermal vibrations of the crystal lattice bleeds off some of the energy imparted to the lattice electrons, allowing them to decay into, typically, a range of lower energy metastable states. Such electrons, over time, spontaneously decay (luminesce) to a range of lower, more stable, energy states, emitting a light photon having an energy quanta (frequency) equalling the energy difference between the metastable energy state and the particular lower energy state in the crystal lattice. As is well established, a photon having the particular energy quanta (frequency) equaling the energy difference between the higher metastable energy state and the lower more stable energy state in the crystal lattice can stimulated the electron to spontaneously decay to that lower energy state causing emission of a light photon of the same quanta (energy/frequency) and coherency (phase and direction) as the stimulating photon.

This means that where a particular phosphor and or mix of phosphors provides luminescent light emissions in discreetly different frequency ranges, the mix of the different frequencies of emitted and reflected luminescent photons scattered into and by the emulsion will correspond to those necessary for stimulating radiative emissions from those same phosphors suspended in the emulsion coating 38. Accordingly, it is hypothesized that such stimulated radiative emission contributes to the increase in light emission observed emanating from the region 61 between closely adjacent light tubes 11.

There is also an increase in refraction and scattering of light waves into the emulsion 38 for the innermost tubes within reflector housing 32. In particular, the emulsions 38 of innermost tubes 11 at the apex 33 of the housing 32 subtend/intercept significantly larger relative area in the aperture plane than the outer tubes 11 proximate the light emitting aperture 18. (The aperture plane is defined as a plane oriented parallel to the light emitting aperture 18 bounded by the reflector housing walls.) Accordingly, a significantly greater proportion of the light propagating in the regions of the fixture proximate the apex 33 of reflector housing 32 will be refracted, scattered into, scattered out of, an re-emitted by the emulsions 38 in that region.

Temperature is another factor that should be considered in optimizing performance of the invented luminescent fixture. In particular, as is well known, thermal excitation of the the phosphors crystal lattice causes electrons in the lattice to populate the lower energy states. If the energy states populated by such thermal excitation are the same as those which pumped electrons at the higher metastable energy state preferably decay to provide the desired luminescent radiation there will be a decrease in the amount of luminescence. Additionally, excessive thermal energy (heat) generally degrades performance of the solid state electronic circuitry components of the ballasts. Yet, both the ballasts and the physical phenomenon occurring within luminescent light tube generate heat. Accordingly, care should be taken to determine both optimum operating temperature ranges for luminescent light tubes and for the high frequency, solid state ballasts supplying the electron current pulse trains energizing the luminescent light tubes. In short, excess heat energy should not be allowed to accumulate anywhere in the fixture. And, if the optimum operating temperature regimes of the luminescent light tubes and other electronic components of the fixture are not compatible, then the respective components should be isolated thermally either by appropriate design (FIG. 1) and/or by use of fans to circulate air for cooling the affected and/or offending component. (FIG. 8).

From the above discussion, as taught by the present invention, it should be understood that orientation of the luminescent light emitting tubes 11 in close parallel alignment in a plane located centrally between facing, inclined high reflectivity surfaces increases the intensity (flux density) and enhances the color/chromacity of the emitted luminescent light. Intensity is increased because light emanating from the regions 61 between adjacent tubes 11 can be preferentially directed toward the light emitting aperture 18 at the base of the reflector housing by appropriate adjustment of the angle of the reflector panels relative to the tube plane. Color/chromacity is enhanced because of the joint phenomena of light scattering and stimulated radiative emission in the phosphor containing emulsion 38 coating on the interiors of the luminescent light tubes 11.

In fact, if observation of Ad Lagendijk to the effect that the effective propagation velocity of light in an efficient scattering medium is one tenth that previously assumed, is correct: (i) there will be coincidence in emergence of radiated photons (photons radiated from phosphors within the emulsion 38) and scattered photons (photons from without the emulsion 38) from the emulsion with a resulting increase in light intensity (flux density); and (ii) each stimulated/excited luminescent light pulses will be temporally broadened first by the delay in emergence of the radiated photons and second by the delay in emergence the scattered photons. Such delay in the emergence of photons refracted and scattered by the emulsion coatings 38 will further minimize intensity ripple in collected light emanating from the aperture 18 of the invented fixture.

Figure 5:
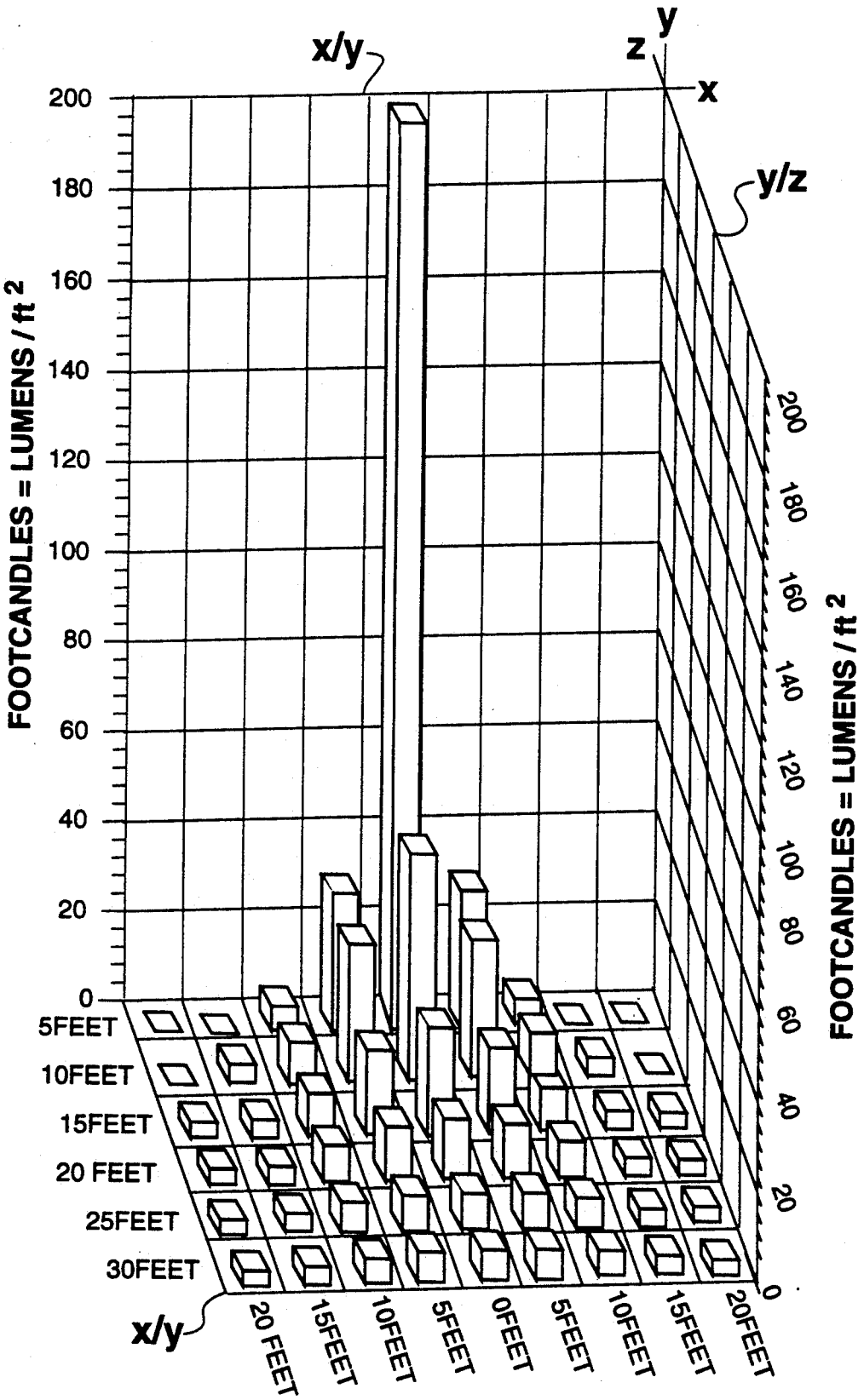
FIG. 5 is a three dimensional 'block' rendering showing light intensity (flux density) measured in foot candles (lumens/ft$^2$) as function of distance from the rectangular opening aperture of the invented illumination fixture.
Figure 6:
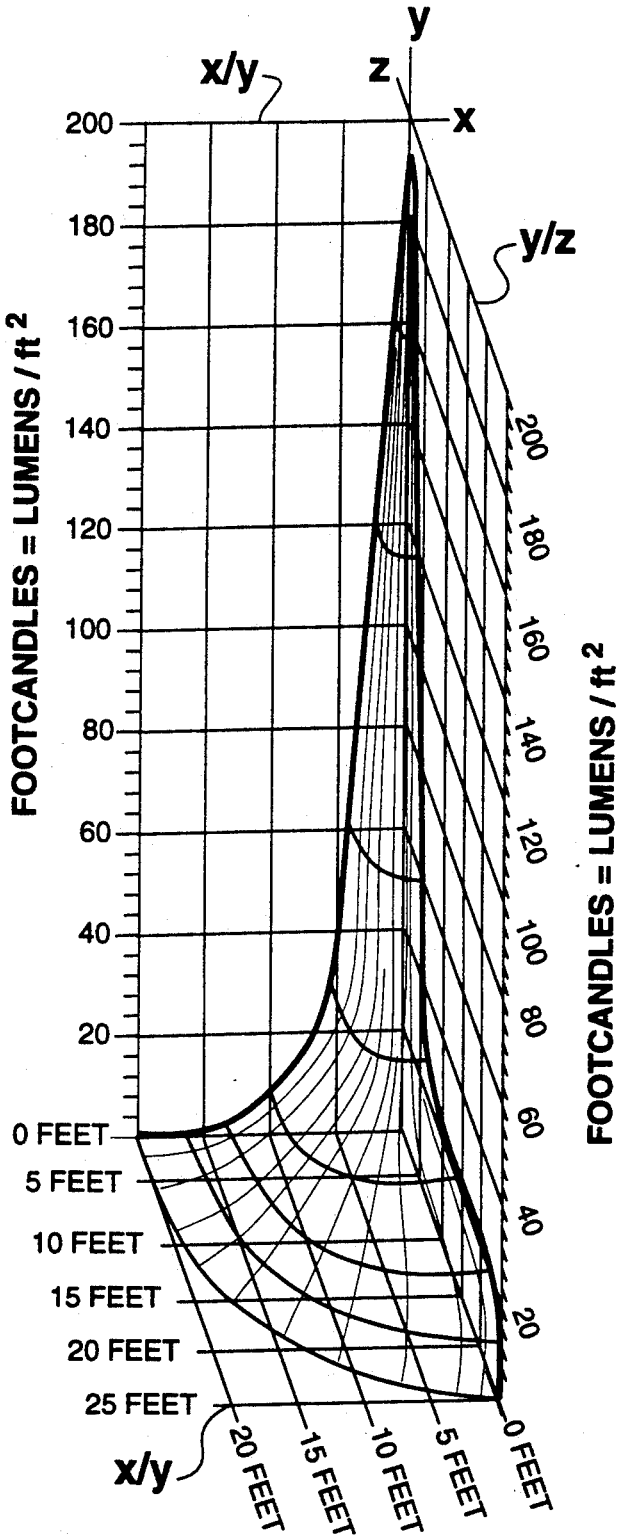
FIG. 6 is a three dimensional line graph illustrating light intensity as a function of distance derived from the 'block' rendering of FIG. 5.

Referring now to the three dimensional graphical renderings presented in FIGS. 5 and 6, showing the spatial distribution of light measured in footcandles (lumens/ft$^2$) as emanating from an invented fixture, it is clear that the result of orienting closely spaced luminescent lamp tubes in a common plane bisecting an acute angle beteeen two high reflectivity inclined surfaces provides a high degree of directionality. For FIG. 5 and 6 the light fixture is oriented such that tube plane 12 (and tilt axis) extends out of the paper parallel the y/z plane. In particular, light levels sharply decrease as you move away from the central tube plane of the fixture in the x/y plane.

It should be realized that other factors also affect the directionality achievable with the invented fixture including reflectivity of the reflecting surfaces, the degree of optical aberration/distortion in different areas of the reflecting surfaces, and alignment of the reflecting surfaces and lamp tubes. It was found that increasing the degree or effective reflectivity of the inclined reflective surfaces provided by the reflector panels of the fixture enhanced the directionality of the emanating light. And, while generally the omnidirectional light emission from a luminescent light tube does not exhibit significant 'hot spots' (small areas of high intensity light) the directional light emanating from the aperture 18 of the invented fixtures will present areas of varying intensity. To smooth such variations in intensity, conventional light diffusing lenses 71 (See FIG. 2) can be disposed across the light emitting aperture of the fixture.

To provide even greater directionality to the light emanating from the aperture 18 of the invented fixtures, light collimators can attached to and mechanically supported on the base 15 of the frame 13 such as the 'egg-crate' collimator 71 illustrated in FIG. 2*a*. In fact, as shown in FIG. 7, the directionality of the light emanating from the aperture 18 at the base of the invented fixtures can be substantially enhanced by disposing a 'honeycomb' collimator 72 across/within the light emitting aperture of the fixture. Ideally, such honeycomb collimators 72 are composed of materials capable providing very thin, high reflectivity cylindrical wall surfaces in order to minimize light loss. As shown, the hollow cylindrical honeycomb cells 73 of the collimator are aligned with their respective axes oriented perpendicularly with respect to the plane of the aperture 18. And, with such a collimator 72, the directionality of emanating light is directly related to length of the hollow cylindrical cells 73 while intensity is inversely related. The radius of the cylindrical honeycomb cells 73 also affects both directionality and intensity of the emanating light. Finally, it should be realized that with honeycomb collimators, the effective aperture of the fixture is decreased by the percentage of the available aperture plane occupied by the material composing/providing the cylindrical honeycomb cells 73.

However, it is possible to diffuse or 'even out' intensity and color/chromacity variations in the 'directed' light emanating from honeycomb collimators by appropriately dimensioning the length and radius of the honeycomb cells. Also variations in color/chromacity in the emanating light can be mitigated by 'coloring' the reflective cylindrical walls of the honeycomb cells. And, in most cases, diffusion lenses and the like are not required an appropriately designed honeycomb collimator.

As a converse to the enhancement in the directionality of light emanating from the apertures of the invented fixture obtained by increasing the reflectivity of the inclined reflector panels 16, it has been discovered that a less directional but highly uniform illumination over a large area without hot spots and frequency differences can be obtained from the invented fixture by using efficient diffusing reflective surfaces on the inclined reflector panels 16. Light emission sources or systems capable of providing highly uniform illumination of large areas are extremely useful, and highly desirable for producing the special 'matte' effects in video and film production.

'Matte' production effects require a 'colored' planer surface for reflecting/scattering illuminating light over a selected frequency range in order to electronically edit and superimpose/combine two or more images. A typical example of the utility of such special 'matte' production effects are video and television news programs which electronically superimposing or combining the active image of talent (a weatherman) in the foreground with an appropriate background image (weather map).

In particular, with reference to FIGS. 1 and 1*a* it was discovered that by providing a smooth 'white' painted reflecting surface on each of the inclined reflector panels 16, a relatively directional and highly uniform illumination pattern over large areas could be obtained for each of the particular ranges of light frequencies emitted by the phosphors selected for the luminescent light tubes 11 mounted in the light tube plane 12 of the fixture. And, it was discovered that such diffusing reflective surfaces presented by the inclined reflector panels 16 eliminated or 'diffused' (scattered) 'hot spots' in the light pattern emanating from the fixture at all the particular ranges of luminescent light frequencies. In particular, a diffusing lense across the light emitting aperture of the fixture was not necessary. Such diffusing lenses while spreading 'hot spots' also decrease the intensity of light available from the fixture.

Further, as is well established in luminescent lighting, it possible to select desired ranges of discreetly separated light emission frequencies (color/chromacity) by appropriate selection and mixture of the phosphors contained in the emulsion coatings deposited on the interior surfaces of the light tubes. This flexibility greatly enhances the utility of the invented fixture for producing special 'matte' effects in that, with the highly uniform luminescent light illumination provided by diffusing 'white' reflecting surfaces on the inclined reflector panels 16, it is possible to uniformly illuminate a particular 'colored' matte wall with a range of light frequencies 'tailored' for both the particular reflecting color of the wall and light sensitivity of the video and/or film camera. Such light frequency 'tailoring' greatly enhances both the degree of isolation of the 'active talent' in the foreground and the resulting visual quality of the superimposed or combined images electronically obtained.

In fact, because discrete ranges of luminescent light frequencies are simultaneously obtainable either through an appropriate mixture of phosphors in emulsions coating the interior surfaces of the light tubes or through an appropriate selection of luminescent light tubes 11 with different luminescing phosphors, with the invented fixture, it is possible to simultaneously and uniformly illuminate a selectively 'colored' wall with discrete frequency ranges of light. If the selectively 'colored' wall preferentially reflect light at the same and/or complementary discrete frequency ranges as the light illuminating the wall, it becomes possible to simultaneously produce different background 'matte' scenes which can be superimposed/combine with an image of active talent in the foreground.

In addition, utilizing the invented luminescent light fixture to illuminate the active talent in the foreground with directed light with still other discrete frequencies ranges adds another degree of flexibility to such special 'matte' production effects, e.g., it allows the foreground lighting to have the exact match in composition as that used to illuminate a pre-recorded background.

Still further flexibility in directing the light output from the invented fixture can be provided by pivotally mounting 'barn door' reflectors 76 along the straight rectangular sides of the aperture 18 provides by the base 15 of the trapezoidal hexahedral frame 13 as indicated in an exemplary fashion in FIGS. 2 and 3. With such 'barn door' reflectors, light can be either deflected away from areas where illumination is not desired and/or directed to areas where illumination is desired. As illustrated, the 'reach' or width of the exemplary barn door reflectors 76 appear short relative to the width of the rectangular aperture 18. It should be realized that the particular width and even shape of a particular 'barn door' reflector will vary with application and illumination effect desired. The point is, that the degree of light intensity obtainable from the invented fixture, makes it suitable for primary illumination applications where the ability to shape or edit the illuminating light provides additional flexibility.

The invented luminescent fixture for providing directed lighting suitable for television, video and film production application has been described in context of representative, exemplary and preferred embodiments. Many modifications and variations can be made to the invented luminescent light fixture, which, while not exactly described in the foregoing specification, fall within the spirit and the scope of the invention as described and set forth in the appended claims.

I claim:

1. A luminescent light fixture for providing sustained and directed, primary illumination comprising in combination, a) a plurality of luminescent lamp tubes aligned in close parallel proximity in a common lamp tube plane supported by a frame structure, b) a pair of facing high reflectivity surfaces having quadrangular perimeters supported by the frame structure with the plurality of lamp tubes between the facing high reflectivity surfaces and with their respective quadrangular perimeters equidistant from and inclined at equal acute angles relative to the tube plane, c) a plurality of electrical energizing means mounted on the frame structure, each electrically connected for supplying electron current pulses to at least one of the lamp tubes at a rate sufficient to excite/-stimulate pulsed fluorescence and phosphorescence light emission of a desired color/chromacity from phosphors suspended in emulsion coatings lining interior tubular surfaces of the lamp tubes, each pulsed fluorescence and phosphorescence light emission pulse having a duration greater than that of the exciting electrical current pulses, such that each luminescent light pulse emitted overlaps emission of the subsequent luminescent light pulse excited/stimulated in each tube, whereby, sustained luminescent light emission emanates from each tube, and d) a source of electrical power electrically connected to the electrical energizing means supplying electrical current to each of the electrical energizing means.

2. The luminescent light fixture of claim 1 and further including, e) an inward facing high reflectivity apex surface located at an apex area bridging between respective proximate parallel perimeters of the inclined pair of facing high reflectivity surfaces, f) at least two inward facing, high reflectivity end surfaces, each located at end areas for bridging between respective proximate diverging perimeters of the inclined pair of facing high reflectivity surfaces, whereby, a reflector housing is provided having the shape of a trapezoidal hexahedron with inwardly facing high reflectivity surfaces at its apex, its inclined sides and its ends and a substantially quadrangular aperture coinciding with its base.

3. The luminescent light fixture of claim 2 wherein:

(i) the quadrangular perimeters of the facing pair of highly reflective surfaces are rectangular;

(ii) the luminescent lamp tubes and the rectangular perimeters of the facing pair of high reflectivity surfaces all are of approximately equal lengths; and (iii) wherein the lamp tubes are aligned in close parallel proximity within a rectangular area defined by perpendicular projection of the rectangular perimeters of the pair of facing high reflectivity surfaces onto the lamp tube plane.

4. The luminescent light fixture of claim 3 wherein the luminescent lamp tubes are 'U-shaped' and extend from opposite sides of the frame structure to interleave in the lamp tube plane.

5. The luminescent light fixture of claim 3 wherein the facing pair of high reflectivity surfaces are optically shaped for reflecting light emanating from the light plane toward the aperture at the base of the housing.

6. The luminescent light fixture of claim 5 wherein the facing pair of high reflectivity surfaces are flat.

7. The luminescent light fixture of claim 2 wherein the luminescent lamp tubes are 'U-shaped' and extend from the apex toward the base of the reflector housing in close parallel proximity in at least one parallel lamp tube plane.

8. The luminescent light fixture of claim 7 wherein the 'U-shaped' luminescent lamp tubes have a length at most equal to a perpendicular distance measured between the apex and base of the reflector housing and extend from the apex toward the base of the reflector housing in close parallel proximity in at least two parallel lamp tube planes.

9. The luminescent light fixture of claim 7 wherein the reflector housing is in the approximate shape of a frustum of a regular pyramid with a central axis, the lamp tube plane becoming a line coinciding with the axis of the pyramid, the 'U-shaped' lamp tubes extending in close parallel proximity symmetrically around that axis.

10. The luminescent light fixture of claim 7 and further including:

(i) an exterior housing comprising the frame structure of the fixture, joining with perimeter edges of the quadrangular aperture and extending exteriorly from the perimeter of the aperture around the inclined sides and ends of the reflector housing to provide an hexahedral electrical component volume behind the apex of the reflector housing for housing electrical components of the fixture including the electrical energizing means;

(ii) a removable electrical power unit containing a rechargeable source of direct electrical current for insertion into the component volume to electrically connect with the electrical energizing means;

(iii) venting cut through the exterior housing for allowing exterior air entry into and through its interior;

(iv) a electrically driven fan for circulating the exterior air into and through the interior of the exterior housing; and (v) shielding means for preventing radio frequency electromagnetic energy broadcast from electrical components within the fixture including a 'honeycomb' light collimator composed of an electrically conductive material, supported within and having a perimeter contiguous with the aperture of the reflector housing; and (vi) an alternative current supply means adapted for connection to an external electrical power source electrically connected to the electrical energizing means for alternatively selecting between an alternating current source and a direct current source of electrical power as a source for the electrical current supplied to the energizing means.

11. The luminescent light fixture of claim 2 wherein the inwardly facing high reflectivity surfaces of the reflector housing are efficient light scattering, reflecting surfaces which direct luminescent light out of the aperture at the base of the housing for uniformly illuminating large surface areas.

12. The luminescent light fixture of claim 11 wherein the inwardly facing high reflectivity surfaces of the reflector housing are coated with a thin smooth white material.

13. The luminescent light fixture of claim 12 and further including a special effects production system, in combination therewith comprising:

(i) a flat vertical matte surface positioned for illumination by the luminescent light radiating from the aperture of the reflector housing of the luminescent light fixture, the matte surface radiating a discrete range of light frequencies of the illuminating luminescent light within a primary color;

(ii) a color sensitive electronic scanning imaging system for scanning talent action before the illuminated vertical matte surface and producing video image signals comprising of a talent action portion and that discrete range of light frequencies in the primary color radiated by the matte surface, (iii) video signal processing means receiving the produced video image signals for separating the talent action portion of said produced video image signals and combining it with other video image signals, whereby, a special effect, composite image showing said talent action before a background image corresponding to the other video image signals can be produced.

14. The combination of claim 13 wherein the flat vertical matte surface reflects the illuminating luminescent light at a particular range of frequencies electronically sensed and interpreted by the electronic scanning imaging system for producing at least one selectable element of the produced video image signals.

15. The combination of claim 13 wherein the flat vertical matte surface is transparent having a primary color pigment which transmits a discrete range of light frequencies of the illuminating luminescent light which in turn is electronically sensed and interpreted by the electronic scanning imaging system for producing at least one selectable element of the produced video image signals.

16. The combination of claim 14 wherein the talent action and the vertical matte surface are illuminated by the luminescent light radiating from the aperture of the reflector housing, and wherein the other video image signals are produced by the color sensitive electronic scanning imaging system interpreting a background scene illuminated by the same luminescent light fixture at a different time, whereby, the talent action portion of the produced video image signals and such other video image signals exhibit approximately the same luminance and chrominance values.

17. The combination of claim 14 or 15 further including a second luminescent light fixture directing sustained luminescent light emanating from a plurality of lamp tubes aligned in close parallel proximity, equidistant between an inclined pair of facing reflective surfaces of a trapezoidal, hexahedral reflector housing having inwardly facing, high reflectivity, flat surfaces and an aperture coinciding with its base, for illuminating the talent action with light including a set of discrete frequency ranges for the particular primary color, outside the range of light frequencies of that primary color radiating from the matte surface, and wherein the other video image signals are produced by the color sensitive electronic scanning imaging system interpreting a background scene illuminated by the second luminescent light fixture at a different time, whereby, the talent action portion of the produced video image signals and such other video image signals have essentially the same luminance and chrominance values.

18. The combination of claim 17 and further including a third luminescent light fixture providing directed sustained luminescent light emanating from a plurality of lamp tubes aligned in close parallel proximity, equidistant between an inclined pair of flat facing surfaces coated with an efficient light scattering, reflecting material which directs luminescent light out of an aperture at a base of a trapezoidal, hexahedral reflector housing, uniformly illuminating a background scene with luminescent light having the same set of discrete frequency ranges as the second luminescent light fixture illuminating the talent action, and wherein the other video image signals are produced by a second color sensitive electronic scanning imaging system interpreting the background scene illuminated by the third luminescent light fixture, whereby, the talent action portion of the produced video image signals and such other video image signals have essentially the same chrominance values.

19. The combination of claim 13 wherein the illuminated flat vertical matte surface radiates at least two different, discrete and separated light frequencies of the illuminating luminescent light, falling within at least one primary color frequency range, and wherein the video image signals produced by the color sensitive electronic scanning imaging system includes selectable portions attributable to the two discrete ranges of light frequencies radiated by the matte surface, and wherein the video signal processing means also includes means for separately separating an image of at least one of the discrete and separated light frequencies reflected by the matte surface from that of the other in said produced video image signals and combining it with a second set of other video image signals, whereby, a composite image showing said talent action before background images corresponding to at least two other video image signals can be produced.

20. The luminescent light fixture of claim 1 wherein the luminescent lamp tubes each contain a low density gaseous medium which includes mercury vapor for producing pulses of ultraviolet light responsive to pulses of electrons supplied to the tubes by the plurality of electrical energizing means, each ultraviolet light pulse then stimulating/exciting luminescent light emission from the phosphors suspended in the emulsion coatings lining the interior tubular surfaces of the tubes.

21. The luminescent light fixture of claim 20 wherein the emulsion coatings lining the interior tubular surfaces of the lamp tubes includes an effective light scattering component.

22. The luminescent light fixture of claim 20 wherein the emulsion coatings lining the interior tubular surfaces of the lamp tubes includes an effective light scattering component for each desired luminescent light frequency stimulated/excited by the pulses of ultraviolet light.

23. The luminescent light fixture of claim 21 or 22 wherein the luminescent lamp tubes are spaced sufficiently proximate to each other that increased light intensity emission is observed emanating from the proximate surfaces of adjacent tubes.

24. The luminescent light fixture of claim 23 wherein the luminescent lamp tubes are proximately spaced at a distance for maximizing light emission from the proximate surfaces of adjacent tubes.

25. The luminescent light fixture of claim 23 wherein the lamp tubes are proximately positioned at a distance for maximizing areas of the proximate surfaces of adjacent tubes from which the increased light intensity emission is observed emanating.

26. The luminescent light fixture of claim 23 wherein the quadrangular perimeters of the pair of facing high reflectivity surfaces are inclined relative to the lamp tube plane at equal acute angles ranging from 30° to 45°.

27. The luminescent light fixture of claim 26 wherein the quadrangular perimeters of the pair of facing high reflectivity surfaces are inclined relative to the lamp tube plane at an acute angle of 35°.

28. The luminescent light fixture of claim 1 further including an electrical current supply means electrically connecting between the source of electrical power and the electrical energizing means for alternatively selecting between an alternating current source and a direct current source of electrical power as a source of electrical current supplied to the energizing means, whereby the fixture can be powered by either alternating current or by direct current sources of electrical power.

29. The luminescent light fixture of claim 1 wherein each electrical energizing means provides electron current pulses in current pulse trains to at least one lamp tube in the lamp tube plane, and the synchronization between the respective pulse trains provided by the respective electrical energizing means is random.

30. The luminescent light fixture of claim 29 wherein the respective current pulse trains in the respective lamp tubes supplied by a particular electrical energizing means are out of phase.

31. The luminescent light fixture of claim 30 and further including adjustable dimming means electrically coupled to each electrical energizing means for electrically decreasing the intensity of sustained luminescent light emanating from the lamp tubes, whereby, the intensity of light emanating from the aperture of the reflector housing can be dimmed.

32. The luminescent light fixture of claim 31 and further including remote switching means connected to the adjustable dimming means for adjusting the intensity of light emanating from the aperture of the reflector housing.

33. The luminescent light fixture of claim 2 and further including an adjustable shuttering means supported by the frame structure within the aperture of the reflector housing for decreasing the intensity of light emanating from the fixture.

34. The luminescent light fixture of claim 33 and further including a remote switching means connected to the adjustable shuttering means for adjusting the intensity of light emanating from the aperture of the reflector housing.

35. The luminescent light fixture of claim 2 and further including a light diffusing transparent lense disposed and supported in the aperture of the reflector housing for diffusing and spreading small areas of high light intensity (hot-spots), whereby, the intensity of light emanating from the aperture reflecting off and illuminating talent action and background is of uniform intensity.

36. The luminescent light fixture of claim 35 wherein the light diffusing lense further has optical properties for uniformly refracting and scattering all frequencies of luminescent light emanating from the aperture, whereby, the light illuminating talent and background is of uniform color/chromacity.

37. The luminescent light fixture of claim 36 and further including at least one external, 'barn-door' reflector panel having a reflective surface, and being pivotally supported by the frame structure adjacent the quadrangular aperture of the reflector housing, whereby light emanating from the aperture can be deflected angularly off an axis of the reflector housing aperture perpendicular to its aperture plane using the reflective surface of the panel.

38. The luminescent light fixture of claim 37 wherein at least one 'barn door' reflector panel is removable.

39. The luminescent light fixture of claim 37 wherein the reflective surface of at least one 'barn-door' panel is an efficient light scattering, reflecting surface provided by a coating containing pigments including titanium dioxide.

40. The luminescent light fixture of claim 35 and further including a light collimating means disposed and removable supported by the frame structure in alignment with the aperture of the reflector housing for collimating the luminescent light emanating from the aperture.

41. The luminescent light fixture of claim 40 wherein the light collimating means is a tubular collimator with its longitudinal axis aligned with a central axis of the reflector housing aperture, perpendicular to its aperture plane, the collimator having: (i) a cross sectional configuration identical to that of the aperture; (ii) multiple, axially aligned, interior walls; and (iii) a tubular length greater than at least one cross section dimension of the reflector housing aperture.

42. The luminescent light fixture of claim 41 wherein the interior surfaces of the collimator are highly reflective.

43. The luminescent light fixture of claim 41 wherein the interior surfaces of the collimator are an efficient light scattering, reflecting surface provided by film coatings containing pigments including titanium dioxide.

44. The luminescent light fixture of claim 2 and further including a 'honeycomb' light collimator composed of an electrically conductive material, supported within and having a perimeter contiguous with the aperture of the reflector housing, the 'honeycomb' collimator having a plurality of open ended, parallel tubular cells aligned for directing light emanating through the aperture in a particular direction relative to a central axis of the reflector housing aperture which is perpendicular to its aperture plane, and for mitigating radio frequency electromagnetic radiation broadcast out the aperture of the reflector housing.

45. The luminescent light fixture of claim 44 wherein the open ended tubular cells of the 'honeycomb' collimator are aligned with their respective longitudinal axes parallel to the central axis of the reflector housing aperture and have a length and diameter optimized for diffusing areas of high intensity light and for uniformly scattering desired luminescent light frequencies excited/stimulated from the lamp tubes.

46. The luminescent light fixture of claim 44 wherein interior walls defining the tubular cells of the 'honeycomb' collimator are thin, and highly reflective of luminescent light frequencies excited/stimulated from the lamp tubes.

47. The luminescent light fixture of claim 45 wherein interior walls defining the tubular cells of the 'honeycomb' collimator are thin and have efficient light scattering, reflecting surfaces provided by film coatings containing pigments including titanium dioxide.

48. The luminescent light fixture of claim 2 wherein the frame structure includes tubular elements composed of an electrically conductive (radio frequency shielding) material supporting the lamp tubes, and wherein the reflector housing is composed of an electrically conductive (radio frequency shielding) material; and further including:

(i) an electrically conductive (radio frequency shielding) structural material enclosing a hexahedral volume secured to the frame structure proximate the apex of the reflector housing for housing the electrical energizing means; and (ii) insulated electrical wiring located within the tubular elements of the frame structure for electrically connecting between each electrical energizing means and at least one lamp tube;

(iii) an optically transparent radio frequency shielding means disposed across the quadrangular aperture of the reflector housing;

(iv) axle means secured to the frame structure for defining a tilt axis coinciding with a longitudinal axis of symmetry of the fixture in the lamp tube plane parallel to the aperture.

49. A luminescent light fixture for providing sustained and directed, primary illumination comprising in combination, a) a frame structure supporting a pair of facing high reflectivity surfaces having quadrangular perimeters which are inclined at an acute angle relative to each other, b) a plurality of luminescent lamp tubes aligned in close parallel proximity in a common light tube plane bisecting the acute angle defined by the perimeters of the pair of facing high reflectivity surfaces, supported by the frame structure between that pair of facing high reflectivity surfaces, c) a plurality of electrical energizing means mounted on the frame structure, each electrically connected for providing electron current pulses to one or more of the lamp tubes at a rate sufficient to excite/stimulate pulsed fluorescence and phosphorescence light emission of a desired color/chromacity from phosphors suspended in emulsion coatings lining interior tubular surfaces of the lamp tubes, each pulsed fluorescence and phosphorescence light emission having a duration greater than that of the exciting electrical current pulses, such that each luminescent light pulse emitted overlaps emission of the subsequent luminescent light pulse excited/stimulated in each tube, whereby, sustained luminescent light emission is excited/stimulated from each tube, and d) a source of electrical power electrically connected to the electrical energizing means supplying electrical current to each of the electrical energizing means.

50. A luminescent light fixture for providing sustained and directed, primary illumination comprising in combination, a) a frame structure supporting a pair of facing high reflectivity surfaces having quadrangular perimeters which are inclined at an acute angle relative to each other, b) a plurality of luminescent lamp tubes aligned in close parallel proximity in a common light tube plane bisecting the acute angle defined by the perimeters of the pair of facing high reflectivity surfaces, the tubes being supported by the frame structure between that pair of facing high reflectivity surfaces, and spaced sufficiently close to each other that increased light intensity emission is observed emanating from the proximate surfaces of adjacent tubes, c) a plurality of electrical energizing means mounted on the frame structure, each electrically connected for providing electron current pulses to one or more of the lamp tubes at a rate sufficient to excite/stimulate sustained luminescent light emission from phosphors suspended in emulsion coatings lining interior tubular surfaces of the lamp tubes, and d) a source of electrical power electrically connected to the electrical energizing means supplying electrical current to each of the electrical energizing means.

* * * * *